US005896578A

United States Patent [19]

Hunter et al.

[11] Patent Number: 5,896,578

[45] Date of Patent: Apr. 27, 1999

[54] ZIPPERLESS NECK ENTRY WETSUIT

[75] Inventors: John D. Hunter, Santa Cruz; Patrick F. O'Neill, Watsonville, both of Calif.

[73] Assignee: O'Neill, Inc., Santa Cruz, Calif.

[21] Appl. No.: 08/958,648

[22] Filed: Oct. 27, 1997

Related U.S. Application Data

[63] Continuation-in-part of application No. 08/819,964, Mar. 18, 1997, abandoned.

[51] Int. Cl.[6] ..... A41D 7/00

[52] U.S. Cl. ..... 2/2.15; 2/69

[58] Field of Search ..... 2/2.15, 2.16, 2.17, 2/69, 71, 908, 455, 456, 82

[56] References Cited

U.S. PATENT DOCUMENTS

| | | | |
|---|---|---|---|
| D. 202,976 | 11/1965 | O'Neill | D3/17 |
| 1,706,097 | 3/1929 | Aud . | |
| 2,582,811 | 1/1952 | Williams | 2/2.1 |
| 3,493,972 | 2/1970 | Oldham | 2/2.1 |
| 3,763,498 | 10/1973 | Rector | 2/2.1 R |
| 4,547,904 | 10/1985 | Long et al. . | |
| 4,809,364 | 3/1989 | Lent | 2/2.1 R |
| 4,862,517 | 9/1989 | Meistrell | 2/2.1 R |
| 4,907,295 | 3/1990 | Yasuda | 2/2.1 R |
| 4,999,845 | 3/1991 | Jenks, Jr. et al. | 2/2.1 R |
| 5,768,703 | 6/1998 | Machado et al. | 2/2.15 |
| 5,806,090 | 3/1998 | Johnson | 2/2.15 |

FOREIGN PATENT DOCUMENTS

| | | |
|---|---|---|
| 1473129 | 3/1967 | France . |
| 7-6097 | 1/1995 | Japan . |

OTHER PUBLICATIONS

Brochure for The Max, O'Neill, Inc., Santa Cruz: United States.

*Primary Examiner*—John J. Calvert
*Assistant Examiner*—Shirra L. Jenkins
*Attorney, Agent, or Firm*—Flehr Hohbach Test Albritton & Herbert

[57] ABSTRACT

A wetsuit (10) having an upper trunk portion (14), a lower trunk portion (12), and a neck region (16) including a neck opening (30). A closure panel (34) seals a V-shaped cut out region (38) that forms part of neck opening (30). Hooks (54) and loops (57) secure closure panel (34) in its closed position. In its open position, closure panel (34) substantially enlarges neck opening (30) to permit entry into and exit from the wetsuit through the neck opening. V-shaped cut out region (38) is limited to the upper trunk portion (14) and a double lined neoprene panel (45) is secured below the apex (43) of the V-neck opening. The double lined neoprene panel (45) acts as a stress disperser, in order to minimize wear and tear at the apex (43).

13 Claims, 11 Drawing Sheets

ZIPPERLESS NECK ENTRY WETSUIT

RELATED APPLICATIONS

This application is a continuation-in-part of application Ser. No. 08/819964, entitled "Zipperless Neck Entry Wetsuit," filed Mar. 18, 1997, now abandoned.

TECHNICAL FIELD

This invention pertains to wetsuits and, more particularly, to zipperless wetsuits with expandable neck openings for entry into and out of the wetsuit.

BACKGROUND ART

Zipperless wetsuits have an advantage over zipper entry wetsuits in that they provide greater flexibility. Zippers by design are relatively rigid components of a wetsuit and, while they can flex to some extent, they can not stretch or contract at all along their length. Thus, when a surfer, for example, bends over or crouches down, a zipper entry wetsuit does not stretch in the back region along the spine, which either limits the surfer's ability to crouch down or causes the wetsuit to tighten in the neck and crotch regions. When a surfer arches his back, the zipper region does not contract, which can result in the neck region riding up the back side of the surfer's neck. Wetsuit designers tend to compromise by providing a zipper that is slightly shorter or longer than ideal.

One of the design challenges in eliminating the zipper from a wetsuit is to provide the neck region with sufficient expansion capability to allow a person to get into and out of the wetsuit, yet also allow the neck opening to be resealed snugly around the neck.

Japanese publication Utility Model Hei 7-6097, published Jan. 27, 1995, entitled "wet suit," discloses a zipperless wetsuit having a V-shaped cut in the neck and front region with a triangular fan shaped gusset sewn into the cut. An elongated, wrap-around strap is attached at the upper end of the cut, and mechanical fasteners secure the strap around the neck. While provision of a sewn-in gusset may improve the waterproof ability of the wetsuit, the gusset has the effect of restricting the extent to which the neck opening can be expanded for entry and may add an undesirable amount of bulk in the neck region.

U.S. Pat. Nos. 4,809,364 of Lent and 4,907,295 of Yasuda disclose zipperless wetsuits and are mentioned for background purposes.

DISCLOSURE OF INVENTION

Briefly described, the wetsuit of the present invention includes an upper trunk portion and a lower trunk portion, and integral leg and arm components, and the improvement resides in the upper region of the upper trunk portion that forms a neck region, which includes a neck opening for entry into and out of the wetsuit. The improvement comprises a cut out region extending from the neck opening to a point sufficiently below the neck opening, and a closure panel for sealing the cut out region and forming a substantially circular neck opening adapted to closely conform to a person's neck. The cut out region forms a part of the neck opening with the closure panel in an open position, with the neck opening being substantially larger when the closure panel is in its open position than with the closure panel in its closed position. The wetsuit is made of relatively elastic material so that the neck opening can expand a limited extent to assist entry into and out of the wetsuit through the neck opening. An important feature of the invention is that the cut out region is limited to the upper trunk region of the wetsuit so that, with the closure panel in an open position, the neck opening is expandable to an extent no more than necessary to pass the neck opening over the widest point of the person's body. In this manner, entry into and out of the wetsuit is possible through the neck opening, and the cut out region and closure panel are minimized in size to maintain wetsuit flexibility and waterproof ability.

Preferably, the cut out region extends down the upper trunk portion to a point on the back side of the wetsuit associated with a person's shoulder blades. At this point, the expanded neck opening is sufficiently large for entry into the wetsuit, yet the opening is confined to the upper trunk portion of the wetsuit, which simplifies the design of the wetsuit for increased comfort and flexibility. It also improves the waterproof ability of the wetsuit by minimizing leakage through the closure panel and by isolating any leakage to the person's upper shoulder region.

According to an aspect of the invention, the cut out region is V-shaped and includes an apex below the neck opening. The V-shaped outline of the cut out region creates a sufficiently large opening to allow for entry into and out of the wetsuit through the neck opening and also assists in isolating stress forces at the apex of the V-shaped cut out region. To this end, shapes other than a V-shape can be used, so long as the shape tends to isolate or concentrate stress forces at a point where the stress forces can properly be handled by suitable reinforcement.

According to an aspect of the invention, a double lined neoprene panel is provided to reinforce the wetsuit in the area from the apex of the V-shaped cut out region down and laterally of the wetsuit in order to disperse stress concentration forces. Preferably, the panel is made of a material that has approximately twice the tensile strength of the material that the upper trunk portion is made.

The wetsuit of the present invention is zipperless in that no zipper is provided at the point of entry to enlarge an opening for entry and exit from the wetsuit. Zippers may be provided at other locations and for other purposes. In the preferred embodiment, the closure panel is sealable by means of hook and loop fasteners, although other types of mechanical fasteners may be used, so long as they are flexible and have good waterproof ability.

These and other features, objects, and advantages of the present invention will become apparent from the following description of the best mode for carrying out the invention, when read in conjunction with the accompanying drawings, and the claims, which are all incorporated herein as part of the disclosure of the invention.

BRIEF DESCRIPTION OF THE DRAWINGS

Throughout the several views, like reference numerals refer to like parts, wherein.

BEST MODE OF CARRYING OUT THE INVENTION

Reference will now be made in detail to the preferred embodiments of the invention, examples of which are illustrated in the accompanying drawings. While the invention will be described in conjunction with the preferred embodiments, it will be understood that the described embodiments are not intended to limit the invention specifically to those embodiments. On the contrary, the invention is intended to cover alternatives, modifications and equivalents, which may be included within the spirit and scope of the invention as defined by the appended claims.

Figure 1:
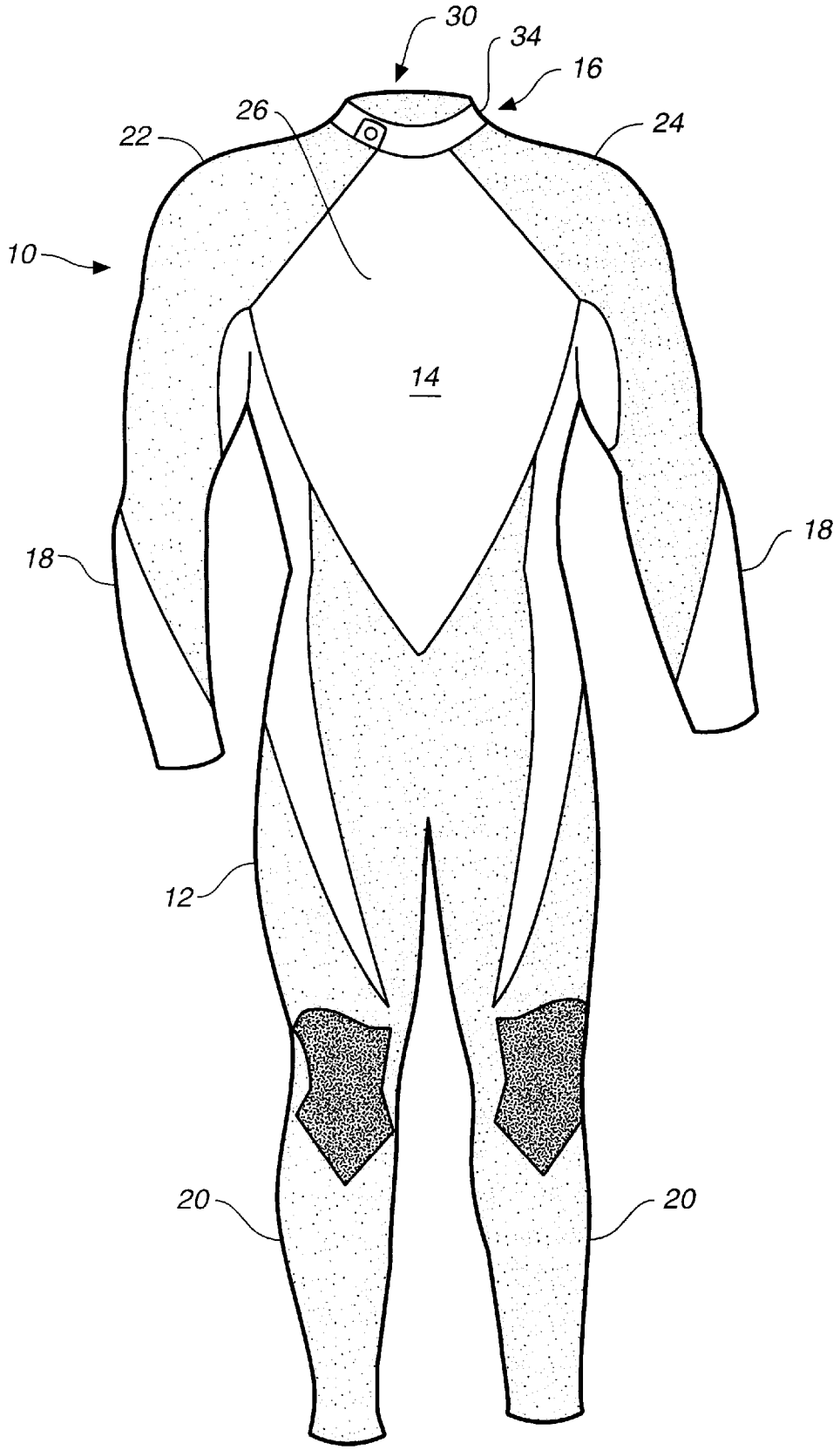
FIG. 1 is a front view of the wetsuit of the present invention.
Figure 2:
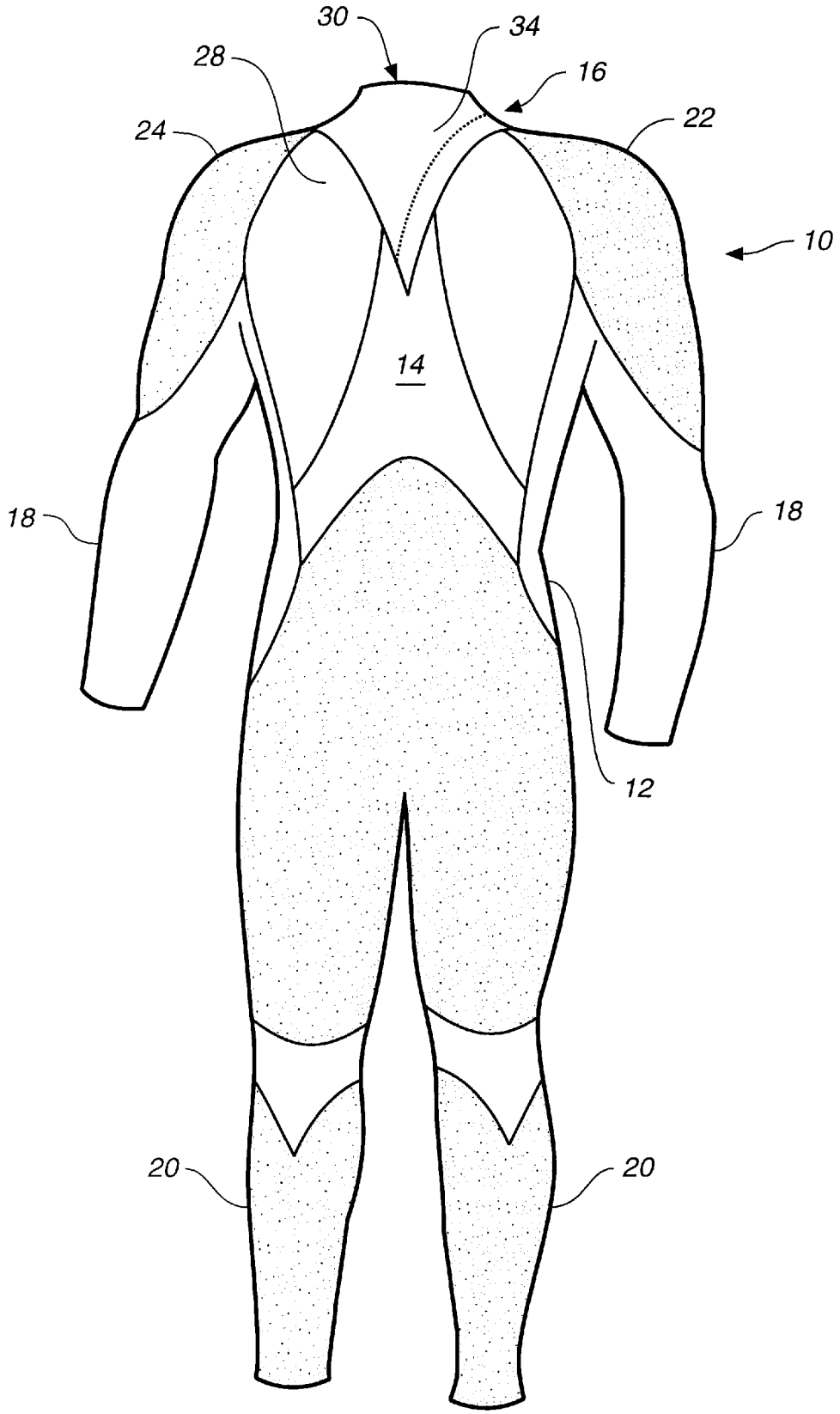
FIG. 2 is a back view of the wetsuit of FIG. 1.

FIGS. 1 and 2 show front and back views, respectively, of the improved zipperless wetsuit 10 of the present invention. Wetsuit 10 includes a lower trunk region 12, an upper trunk region 14, a neck region 16, integral arm components 18, and integral leg components 20. A right shoulder component 22, a left shoulder component 24, a front panel 26, and a back panel 28 generally comprise neck region 16 and define a neck opening 30. Neck opening 30 is further defined by a left back insert panel 34, which is discussed in more detail later.

The present invention resides primarily in neck region 16 and, thus, the particular design of the remaining components of wetsuit 10 can be varied from that shown in FIGS. 1 and 2. Generally, the various component pieces making up trunk regions 12, 14, neck region 16, and arm and leg components 18, 20 can be made from different types of neoprene or other suitable stretchable elastomeric or foam fabric material commonly used for wetsuits. In the preferred embodiment, front panel 26 and back panel 28 are made of #39 Superstretch SL with 7500-10 Jersey/Mesh neoprene available from Yamamoto Corporation, Japan. Other suitable materials are available by the name Ultrastretch neoprene and Flist neoprene from Heiwa Corporation, Japan, Velcro Plush neoprene from Yamamoto Corp., and Neoprene 2DL from Sheico Corporation, Taiwan, China.

Figure 3:
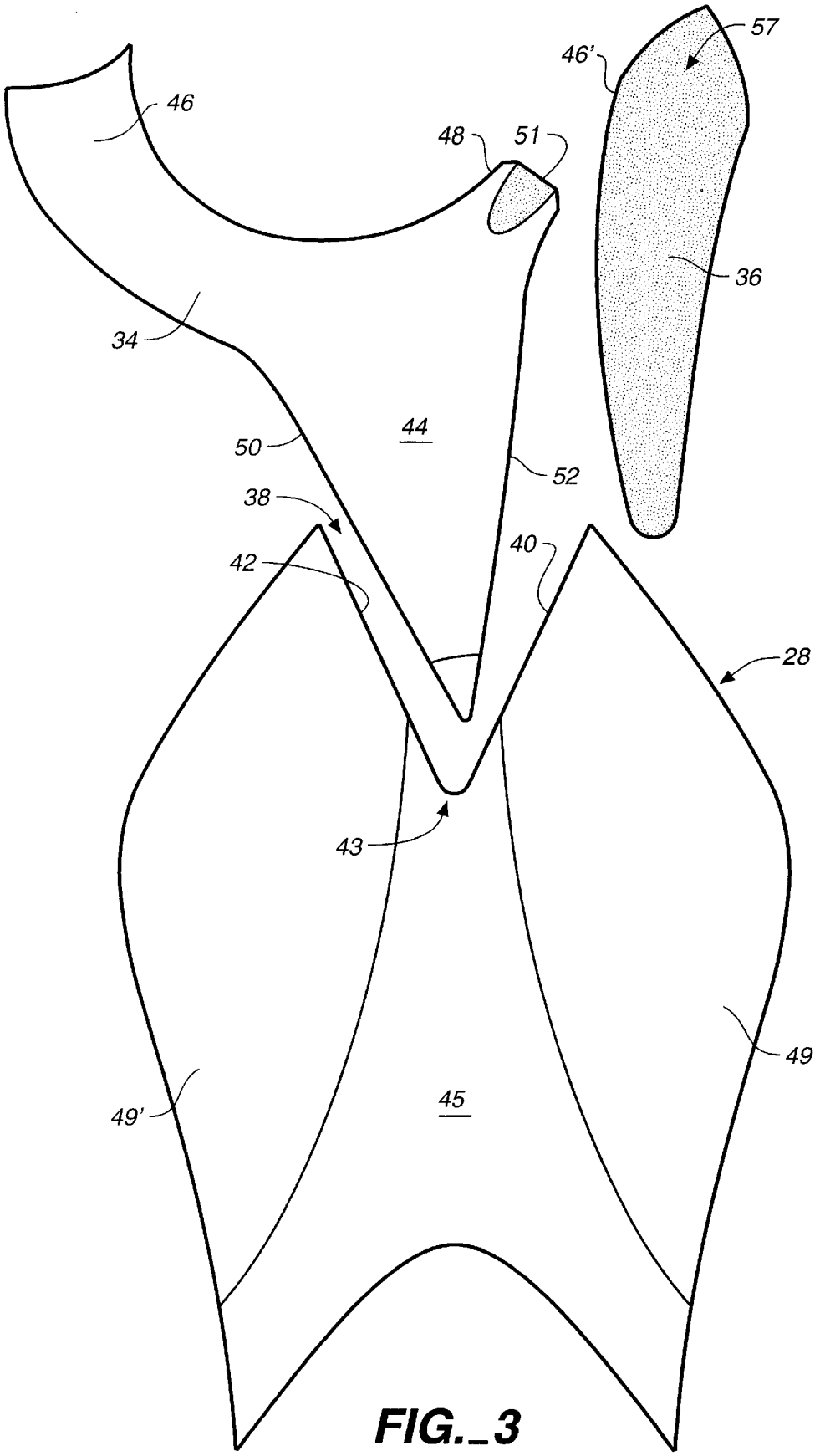
FIG. 3 is an exploded view of the back panel, left back insert and right back insert pieces.

FIG. 3 shows back panel 28, left back insert piece 34, and a right back insert piece 36. Left back insert piece 34 and right back insert piece 36, when assembled and secured to the other neck region components in a closed position are the two pieces that form the collar of the wetsuit and thereby directly define neck opening 30. Back panel 28 has a V-shaped cut out region 38 that is defined by a right edge 40 and a left edge 42, which meet to form an apex 43. Left back insert piece 34 has a corresponding V-shaped trunk section 44, a collar flap 46 and a short collar segment 48 that includes loops 51, which form part of hook and loop fasteners, such as Velcro fasteners. Trunk section 44 includes a left side edge 50 and a right side edge 52.

Right back insert piece 36 includes an inside edge 46' that partly defines the neck opening when the components are assembled. Right back insert piece 36 also includes loops 57 across its entire outer surface.

V-shaped cut out region 38 creates an apex 43 formed by the junction of side edges 40, 42. Apex 43 preferably has a curved shape rather than a point in order to better disperse stress forces. Cut out region 38 is sufficiently large, and preferably extends down to a point corresponding to the lower side of a person's shoulder blades, to allow enough expansion of the neck opening so that a person can get into and out of the wetsuit through the neck opening.

Back panel 28 is formed by two shaped pieces 49, 49' of suitable material, preferably neoprene, and a double lined neoprene panel 45 for reinforcement, which is glued and double blindstitched to panels 49, 49'. Double lined neoprene panel 45 extends from above apex 43 down and laterally to the side edges of panel 28. Regardless of the material that double lined neoprene panel 45 and back panel 28 are made from, it is preferable that double lined neoprene panel 45 have substantially greater tensile strength in order to disperse stress forces concentrating at apex 43. This aspect of the invention is discussed in more detail later.

Figure 4:
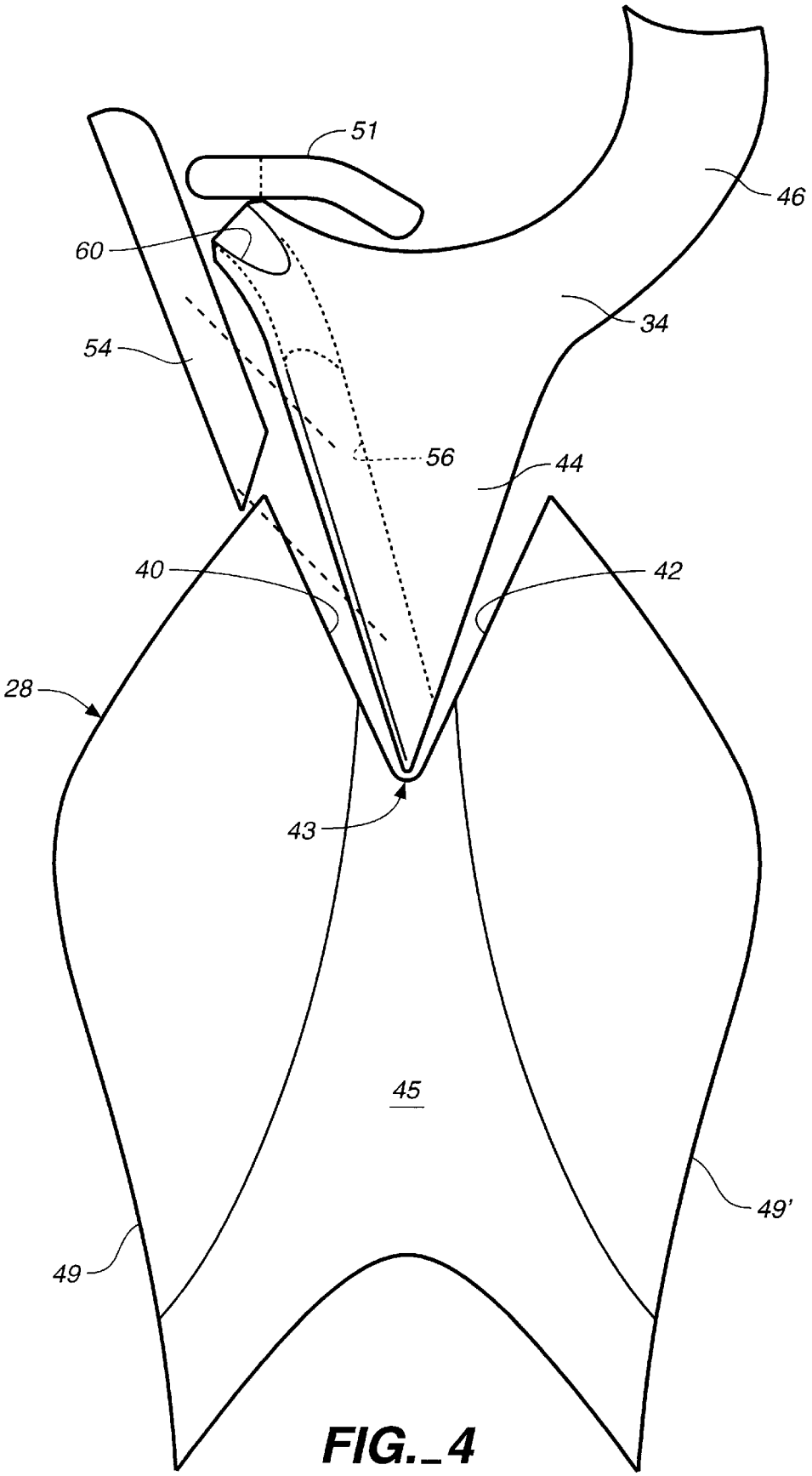
FIG. 4 is an exploded inside view of the back panel, left back insert, hook fastener strip, and hook fastener tab.

FIG. 4 is an inside view of back panel 28 and left back insert piece 34. Right back insert piece 36 is not shown. Left back insert piece 34 includes a hook strip 54 that forms part of a hook and loop fastener, such as a Velcro fastener, for closing the left back insert piece against the right back insert piece. Hook strip 54 is secured by glueing and stitching to left back insert piece 34 in the area indicated by broken line 56. Left back insert piece 34 also includes an angled loop tab 51, which is secured by stitching around the edge of collar segment 48. Line 60 indicates where loop tab 51 is to be secured to collar segment 48.

Figure 5:
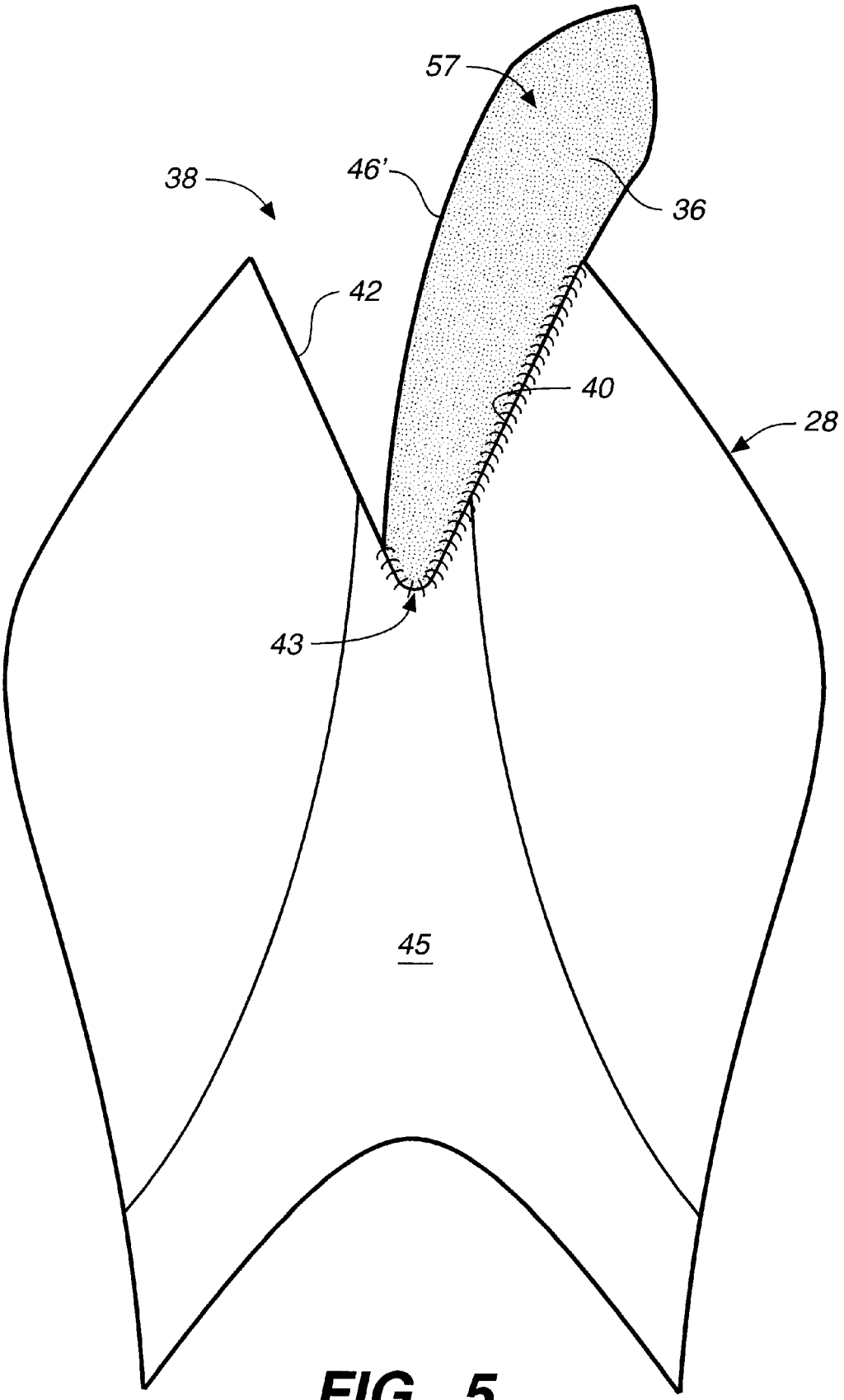
FIG. 5 is an elevation view of the back panel and right back insert piece.
Figure 6:
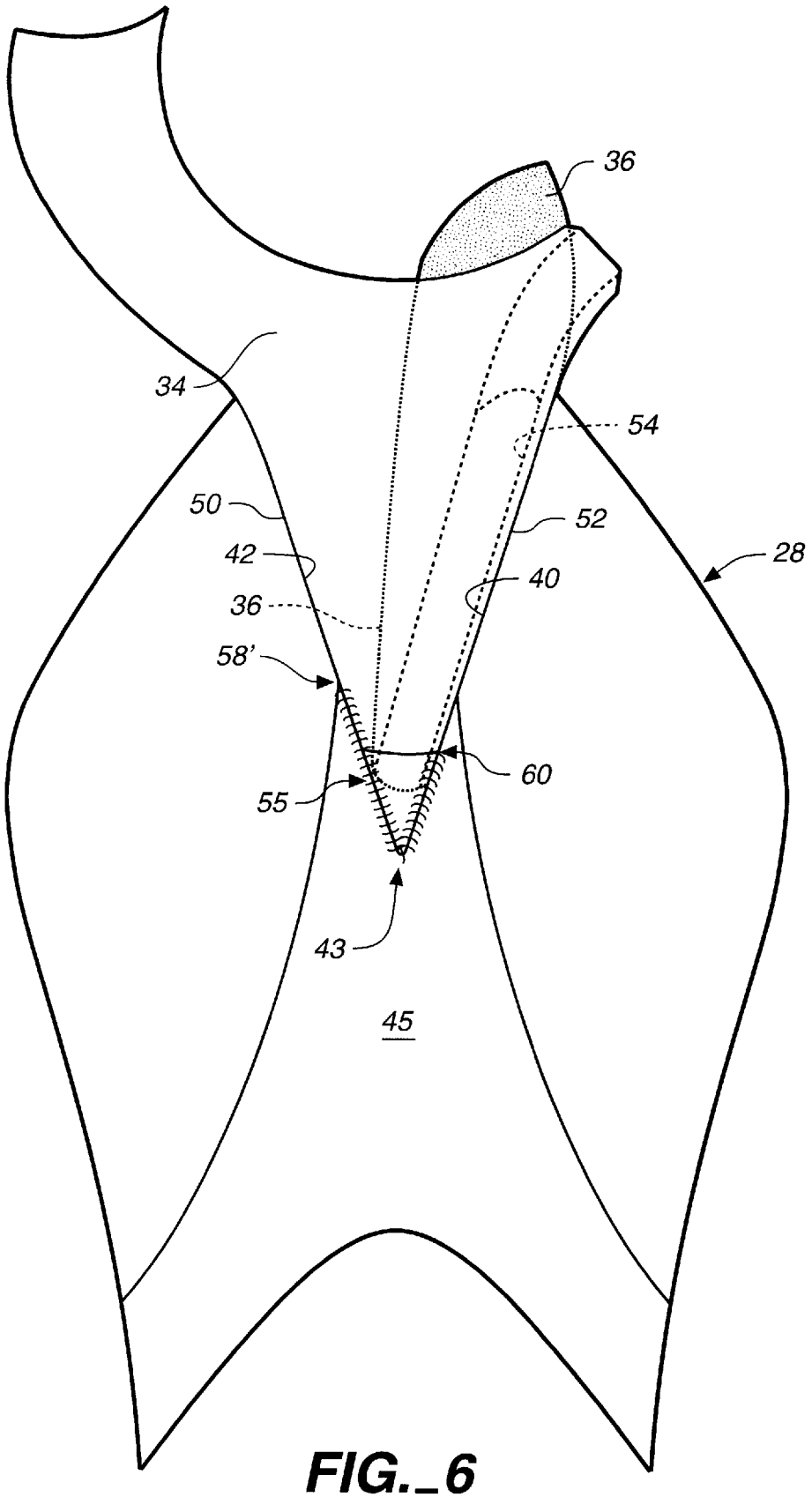
FIG. 6 is an elevation view showing the attachment of the left back insert panel.
Figure 7:
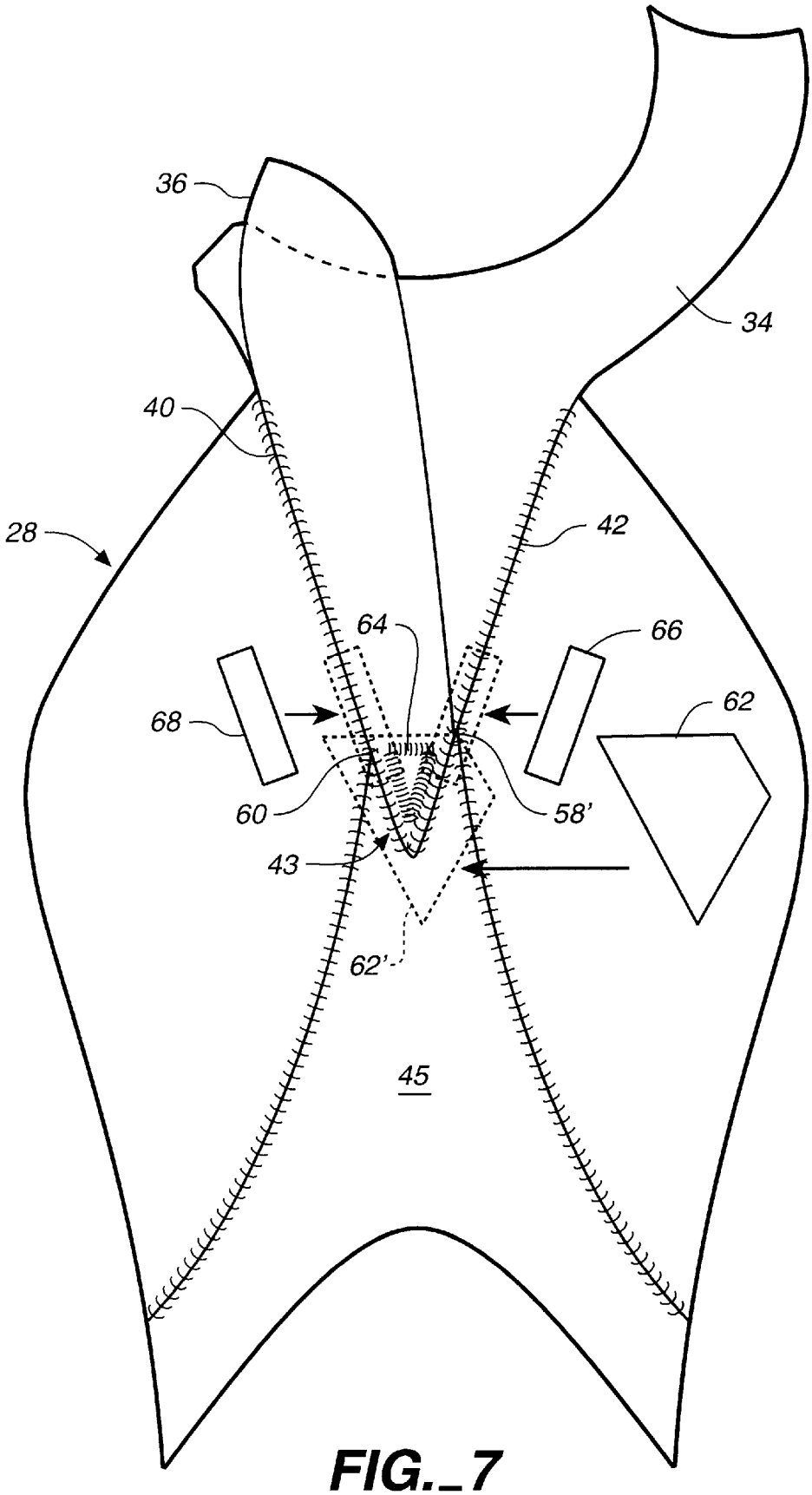
FIG. 7 is an inside view, like FIG. 4, showing the placement of reinforcement patches.

FIGS. 5–7 illustrate the sequence of assembling and forming the neck region. In FIG. 5, right back insert piece 36 includes a bottom edge 47 that conforms with the curvature of apex 43. Right back insert piece 36 is glued and double blindstitched flush to edge 40 and a portion of edge 42. The cross-hatching marks in the figure represent the stitching. The plush, loop side 57 of right back insert piece 36 faces outwardly.

In FIG. 6, left back insert piece 34 is glued along its edge 50 to side edge 42 to the point 55 where it meets right back insert piece 36. At this point, left back insert piece 34 overlaps to the exterior of right back insert piece 36 and is double blindstitched from point 51', through apex 43 and back up along edge 40 to point 60. The stitching is indicated by cross-hatching. From point 60 upwards, edge 52 of left back insert piece 34 is not secured to panel 28.

FIG. 7 shows an inside view of back panel 28. At apex 43, a trapezoidal reinforcement tape piece 62 is shown exploded from its position indicated at 62', where it is heat pressed to portions of back panel 28, double lined neoprene panel 45 and right back insert piece 36, in a position that covers apex 43. A zig-zag stitch 64 is made prior to attaching tape piece 62 in a manner that the stitch extends across the border of right back insert piece 36 and double lined neoprene panel 45, i.e. across the curved portion of apex 43. Tape piece 62 is placed over zig zag stitch 64 in order to keep water from migrating through zig zag stitch 64. In addition, supplemental reinforcement tape pieces 66, 68 may be secured over the seams along edges 40, 42.

Figure 8:
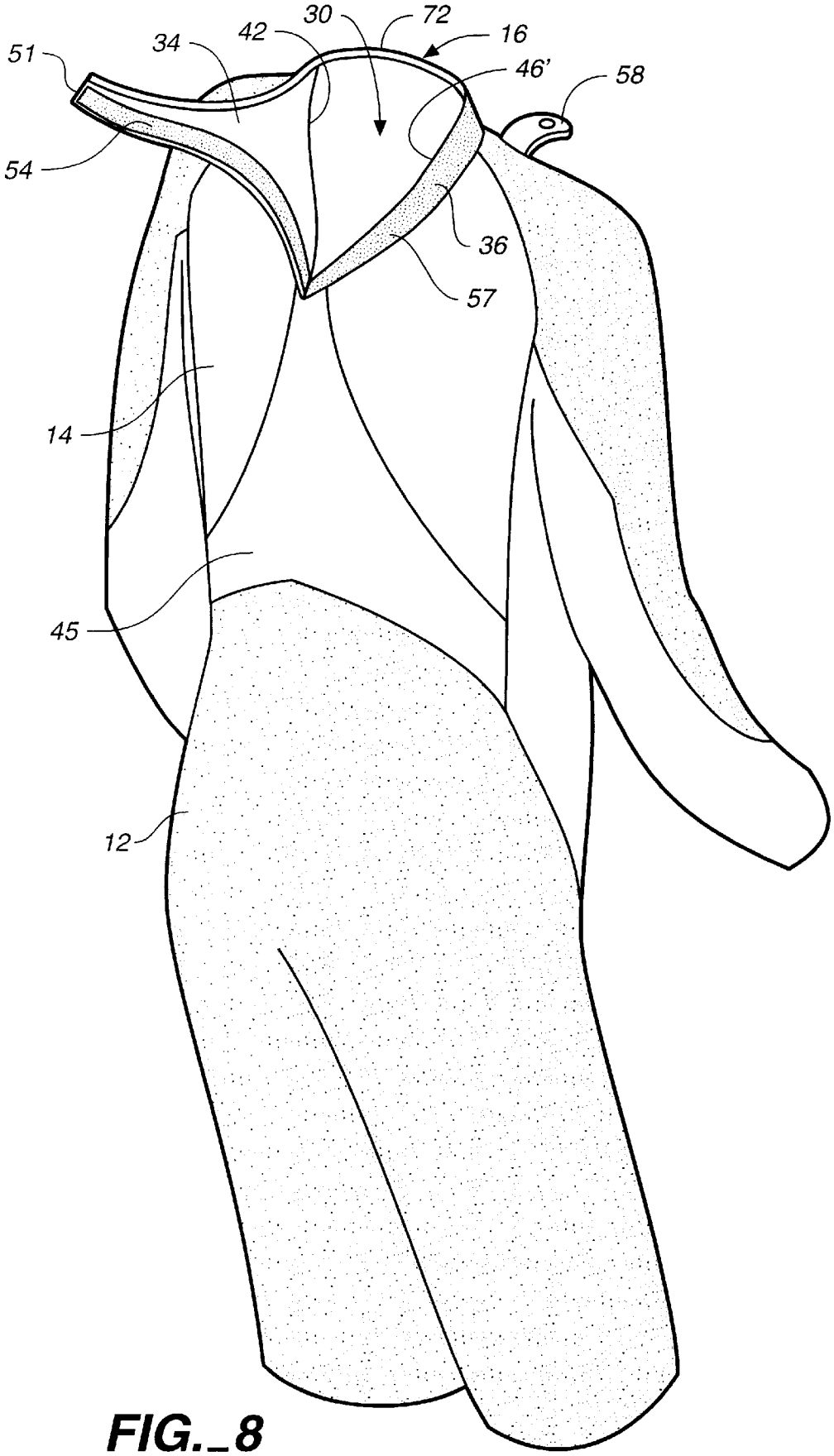
FIG. 8 is a pictorial view of the neck region of the wetsuit of the present invention, as seen from a back side angle view, showing the left back insert flap open.

FIG. 8 shows the upper portion of wetsuit 10, with neck region 16 in an open configuration. Left back insert piece 34 is separated from right back insert piece 36 by the separation of hook strip 54 and loop fasteners 57. Closure tab 58 is positioned at the front of right back insert piece 36 in an open position.

In its open configuration, neck opening 30 forms somewhat of a V-shape, defined by upper edge 72 of left insert piece 34, left edge 42, and inside edge 46'. V-neck opening 30 is substantially larger than when the left back insert piece is secured to the right back insert piece and a circular collar opening is formed. Additionally, the neoprene material of the wetsuit provides a limited yet sufficient degree of stretching to allow V-neck opening 30 to further expand, thus allowing a person to get into and out of the wetsuit through neck opening 30.

Neck opening 30 is designed to open and expand to an extent just sufficient to allow the neck opening to pass over a person's shoulders, which usually form the widest point of the body. In this regard, the cut out region in the back panel extends only partly down the back panel and does not extend down to the lower trunk section of the wetsuit, as many conventional zippers do in zipper entry wetsuits. With conventional zipper entry wetsuits where the zipper extends from the neck opening down almost to the waist, ingress and egress from the wetsuit generally is not significantly limited by the opening formed with the zipper opened. Thus, the zipper is not stressed to a significant degree at its apex and the opening easily passes over the body.

The wetsuit of the present invention is termed a "neck entry" wetsuit because the entry point of the wetsuit is limited to the neck region. The neck opening, when fully expanded, is confined to the neck region. Conventional wetsuits provide openings that extend well down into the lower trunk regions. Thus, the present wetsuit is aptly be described as a neck entry wetsuit.

The present neck entry wetsuit, by confining the V-neck opening to the upper trunk portion and to the area immediately around the neck collar, causes stress at the apex 43 when the neck opening is expanded around a person's body. The design of the apex of the V-neck opening and the double lined neoprene panel below apex 43 disperses concentrated stress forces in a manner that minimizes fatigue and potential wear and tear damage to the wetsuit. This is discussed in more detail with reference to FIG. 11.

Figure 9:
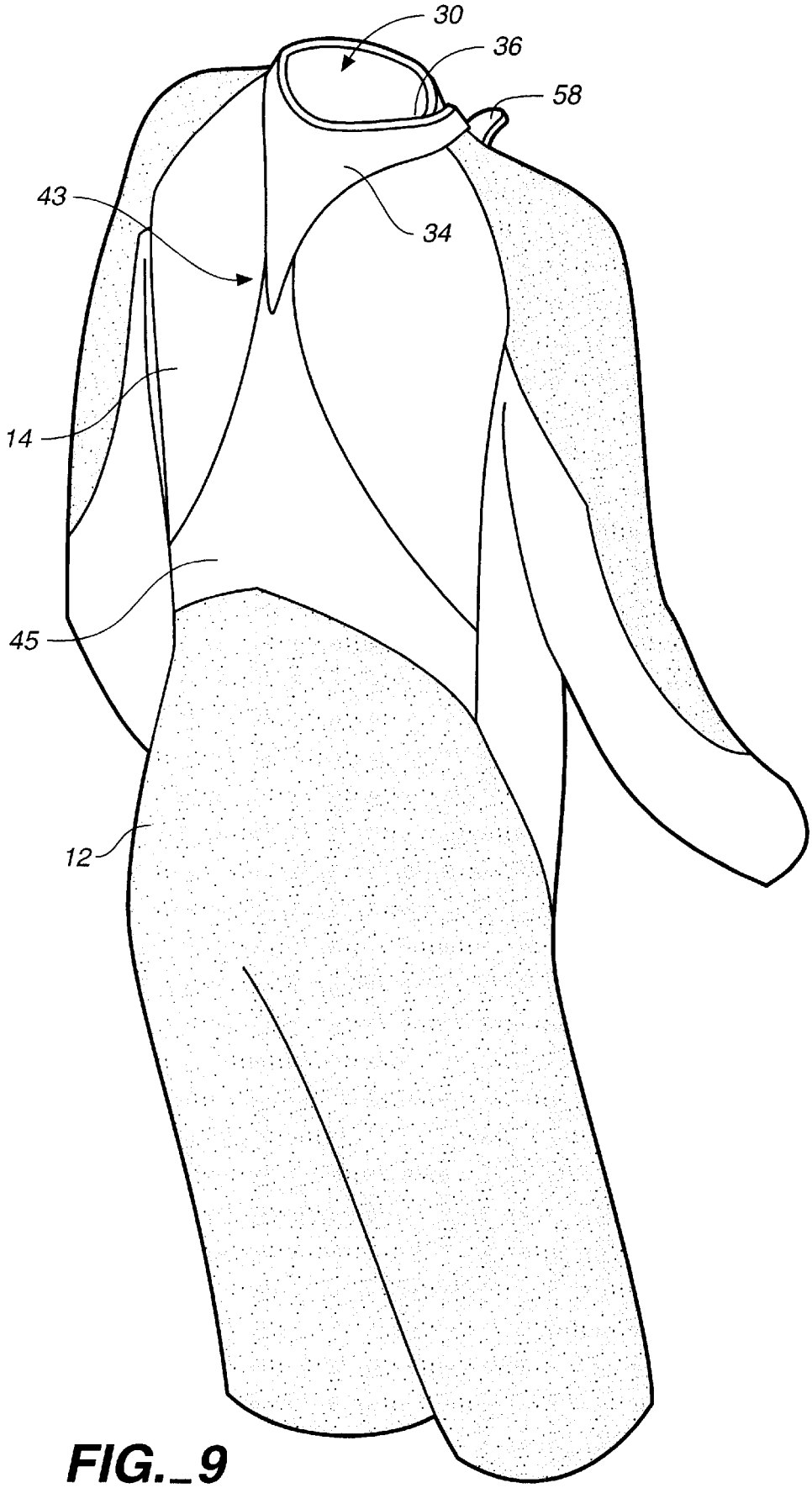
FIG. 9 is a pictorial view like FIG. 8, showing the left back insert flap closed but with the closure tab open.
Figure 10:
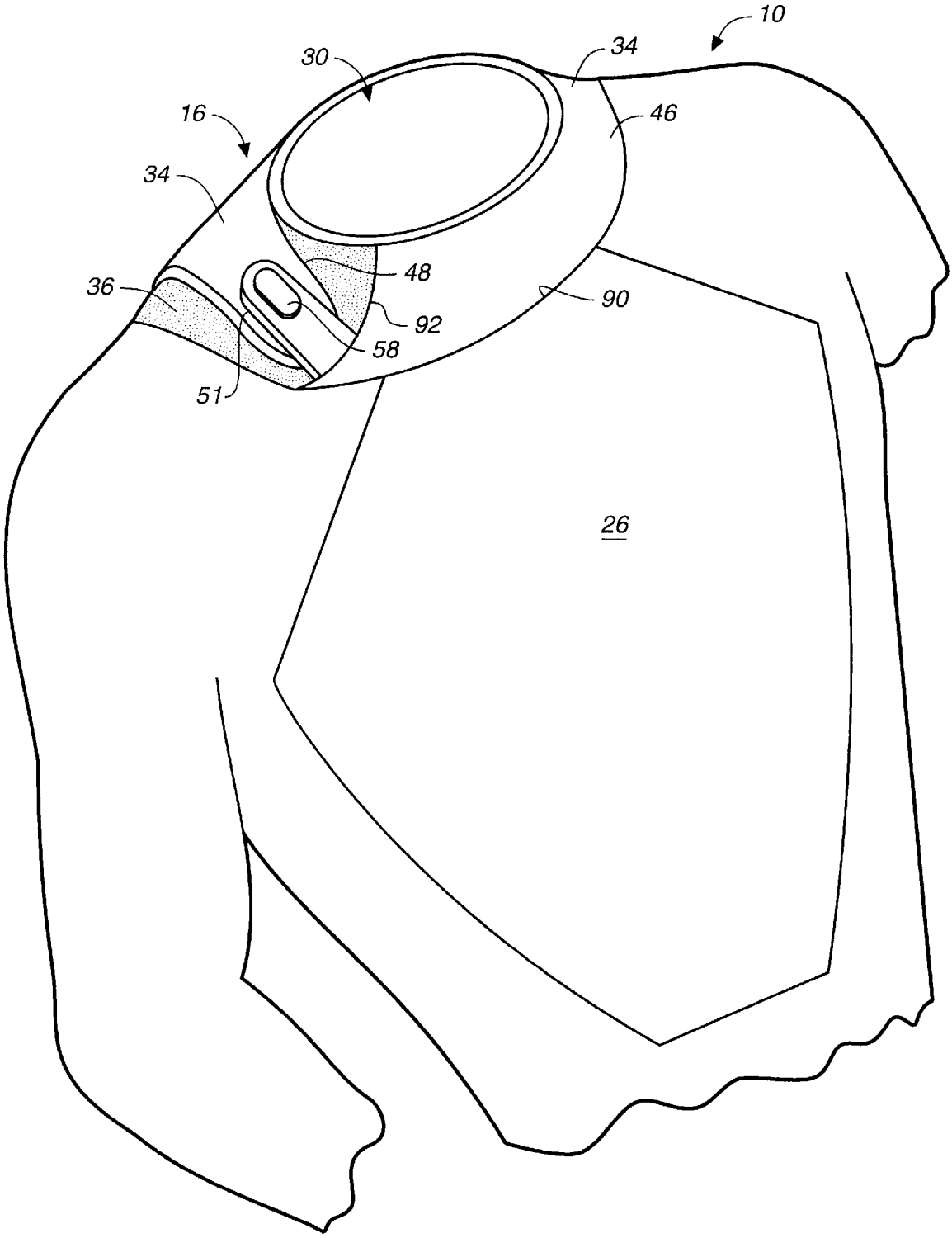
FIG. 10 is a pictorial view of the neck region as seen from a front side angle view, showing the left back insert flap closed and the closure tab sealed.

In FIG. 9, left back insert piece 34 is closed onto right back insert piece 36. Closure tab 58 is in its open position. In FIG. 10, closure tab 58 is closed in a sealed position onto loop tab 51 of collar segment 48. In its closed position, neck region 16 forms a substantially smaller circular neck opening 30, which snugly seals around a person's neck.

FIG. 10 also shows how extension 46 of left back insert piece 34 is secured along edge 90 of front panel 26 and along edge 92 to right back insert piece 36.

Figure 11:
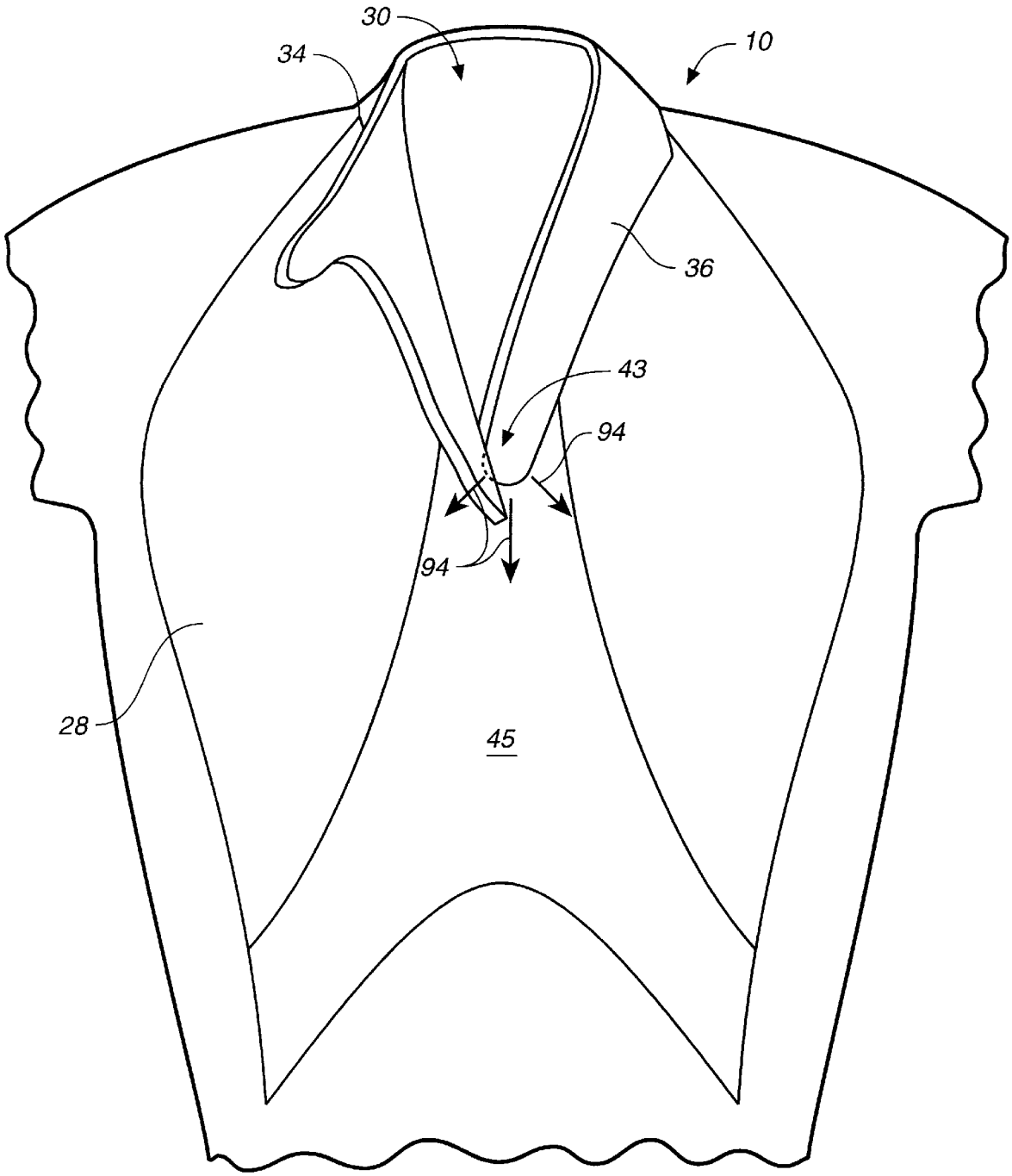
FIG. 11 is a back elevation view of the wetsuit of the present invention showing the migration of stress forces from the apex of the cut out region to the reinforced panel.

As shown in FIG. 11, left back insert piece 34 and the cut out region of back panel 28 are limited to the upper trunk region 14 and preferably to the area of back panel 28 associated with a person's shoulder blades. By limiting the cut out region to the upper trunk region, any water leakage that may occur through the Velcro fastener of the insert pieces is limited to the upper trunk region. In addition, leakage is isolated in the upper trunk region due to the close conformity of the wetsuit to the area in between the shoulder blades. In other words, the leakage does not migrate down the back into the lower trunk region because the wetsuit maintains a contoured fit in the shoulder blade region. Consequently, below the cut out region and over the lower trunk region of the wetsuit, as well as over a portion of the upper trunk region, the wetsuit's flexibility and water tightness is completely undisturbed.

In addition, by limiting the entry of the wetsuit to the neck region, the shape and contour of the wetsuit can be maximized to conform to a person's body. The left and right back insert pieces are entirely flexible in all directions and the only components acting to limit flexibility are the hook and loop fasteners and the stitching, both of which, however, provide a significant degree flexibility. In fact, the stitching and hook and loop fasteners have sufficient flexibility to allow the wetsuit to be shaped to conform to the body. Whereas conventional zippers can significantly limit a wetsuit's ability to flex and to provide a body contoured shape, the present invention maximizes wetsuit flexibility, comfort and shape by eliminating zippers at the entry point.

An advantage of maximizing the flexibility of the wetsuit and of conforming the shape of the wetsuit to a person's body is that the waterproof integrity of the wetsuit is improved. The design of the insert pieces, in particular their minimum size, improved contoured shape, and enhanced flexibility, reduces the potential for water leakage through the seal of the closure panel.

In FIG. 11, left back insert piece 34 is shown separated from right back insert piece 36 and, thus, neck region 16 is in an open position. When V-neck opening 30 is expanded to allow a person entry through the neck opening, apex 43 receives the majority of the stress forces. As shown by arrows 94, stress forces move down from apex 43 and disperse within double lined neoprene panel 45. Specifically, the stress forces move down and laterally of the panel 45, which disperses the stress forces across a greater area and thereby increases the wetsuit's ability to withstand such forces. As shown, it is preferable for the double lined neoprene panel 45 to extend down and laterally sideways of the wetsuit to the side edges of back panel 28. However, the extent of double lined neoprene panel 45 can be shortened, so long as it is able to disperse stress forces across a great enough area to minimize wear and tear on the wetsuit.

The advantage of the present invention is the improved design of the neck entry opening and its simple closure mechanism. The neck entry opening is confined to the upper neck region of the wetsuit and is made with a flexible material having a contoured shape to conform with the outline of a person's back region. As a result, flexibility and water tightness are maximized. In addition, since minimizing the neck entry opening tends to increase stress forces around the opening, an improved stress dispersion design is provided at the point of stress concentration.

As used herein and in the claims, the term "zipperless" is meant to refer to a wetsuit that does not provide a zipper at the point of entry into and out of the wetsuit. This term does not preclude the provision of zippers at other points of the wetsuit, such as may be found at the leg and arm cuffs.

The left and right back insert pieces are separate pieces for ease of manufacturing purposes, but could alternatively by provided as a single piece, with the disclosed hook and loop fasteners secured at the appropriate locations. The term "closure panel" is used in the claims to refer to the feature of the left and right back insert pieces of closing off the cut out region and sealing the cut out region up to the neck opening. Rather than provide separate insert pieces for this purpose, alternative designs can include a cut down from the neck opening with a suitable overlapping flap and hook and loop fasteners. With this embodiment, separate insert pieces do not form the collar of the neck region, as with the disclosed embodiment of the present invention.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto when read and interpreted according to accepted legal principles such as the doctrine of equivalents and reversal of parts.

What is claimed is:

1. A zipperless wetsuit comprising an upper trunk portion having integral arm components, and a lower trunk portion having integral leg components, the upper trunk portion having a neck region that defines a neck opening for entry into and out of the wetsuit, the neck region including a cut out region extending from the neck opening to a point below the neck opening, the upper trunk portion including a closure panel attached to the neck region for sealing the cut out region and formed to provide a substantially circular neck opening adapted to closely conform to a person's neck, the closure panel having an open position wherein it is detachable from one side of the cut out region, the cut out region forming a part of the neck opening with the closure panel in its open position, the neck opening being substantially larger with the closure panel in its open position than with the closure panel in its sealed position, the wetsuit being made of relatively elastic material so that the neck opening including the cut out region can expand a limited extent to assist entry into and out of the wetsuit through the neck opening, the cut out region being limited to the upper trunk region of the wetsuit so that, with the closure panel in an open position, the neck opening is expandable to an extent no more than necessary to pass the neck opening over the widest point of the person's body, the cut out region extends down the upper trunk portion to a point on a back panel associated with a person's shoulder blades.

2. The wetsuit of claim 1 wherein, the cut out region is V-shaped and includes an apex below the neck opening.

3. The wetsuit of claim 2 wherein, the wetsuit includes a panel for reinforcement extending from the apex of the V-shaped cut out region down and laterally of the wetsuit in a shape that causes stress forces concentrated at the apex to disperse away from the apex.

4. The wetsuit of claim 3 wherein, the panel for reinforcement extends down and lateral to side regions of the wetsuit.

5. The wetsuit of claim 3 wherein, the panel for reinforcement extends from the upper trunk portion down into the lower trunk portion.

6. The wetsuit of claim 1 wherein, the panel for reinforcement is made of a material that has approximately twice the tensile strength of the material from which the upper trunk portion is made.

7. The wetsuit of claim 6 wherein, the upper trunk portion is made of a neoprene material and the panel for reinforcement is made of a double lined neoprene.

8. The wetsuit of claim 1 wherein, the closure panel is sealable by means of hook and loop fasteners.

9. The wetsuit of claim 1 wherein, the closure panel forms an overlapping seal from the lower end of the cut out region up to the circular neck opening.

10. The wetsuit of claim 2 wherein, the apex includes a reinforcement patch secured sections of the upper trunk portion forming the apex.

11. A wetsuit comprising, at least two adjacent panel portions formed of a wetsuit fabric and having opposed edges extending over a length and joined together at a stress concentration point, a panel for reinforcement extending from the stress concentration point in a diverging manner away from the stress concentration point, whereby stress forces tending to separate the panel portions travel from the stress concentration point and disperse through the panel for reinforcement.

12. The wetsuit of claim 11 wherein, the panel for reinforcement extends downwardly and laterally from the stress concentration point.

13. The wetsuit of claim 12 wherein, the panel for reinforcement is made of a material that has approximately twice the tensile strength of the material from which the adjacent panels are made.

* * * * *